US008984843B2

(12) United States Patent
Tak

(10) Patent No.: US 8,984,843 B2
(45) Date of Patent: Mar. 24, 2015

(54) DOME COVER SUPPORTER

(71) Applicant: Koo Hyun Tak, Gyonggi-do (KR)

(72) Inventor: Koo Hyun Tak, Gyonggi-do (KR)

(73) Assignee: Koo Hyun Tak, Gyonggi-do (KR)

( * ) Notice: Subject to any disclaimer, the term of this patent is extended or adjusted under 35 U.S.C. 154(b) by 0 days.

(21) Appl. No.: 14/034,139

(22) Filed: Sep. 23, 2013

(65) Prior Publication Data

US 2014/0230363 A1 Aug. 21, 2014

(30) Foreign Application Priority Data

Feb. 18, 2013 (KR) ..... 10-2013-0017018

(51) Int. Cl.

*E04C 3/00* (2006.01)
*E04B 1/19* (2006.01)
*E04B 1/32* (2006.01)
(Continued)

(52) U.S. Cl.

CPC ..... *E04B 1/1903* (2013.01); *E04B 1/3211* (2013.01); *E04C 2003/0452* (2013.01); *E04B 2001/3241* (2013.01); *E04C 3/02* (2013.01); *E04H 7/065* (2013.01)
USPC ..... 52/834; 52/837; 52/839; 52/222; 52/463; 52/466

(58) Field of Classification Search

CPC ..... E04B 7/00; E04B 1/1903; E04B 1/3211; E04B 2001/3252; E04B 2001/3241; E04C 3/02; E04C 2003/0434; E04C 2003/0421; E04C 3/07; E04C 2003/0452
USPC ..... 52/63, 222, 81.3, 463, 466, 469, 584.1, 52/831, 834, 837, 839, 846; 160/327, 395
See application file for complete search history.

(56) References Cited

U.S. PATENT DOCUMENTS 3,332,197 A * 7/1967 Hinkle ..... 52/844
3,477,752 A * 11/1969 Richter ..... 52/464
(Continued)

FOREIGN PATENT DOCUMENTS

KR 200199410 11/2000
KR 1020040063565 7/2004
KR 101058169 8/2011

OTHER PUBLICATIONS

Preliminary Rejection issued by the Korean Intellectual Property Office on Sep. 5, 2013.
(Continued)

*Primary Examiner* — Brian Glessner
*Assistant Examiner* — Brian D Mattei
(74) *Attorney, Agent, or Firm* — IP & T Group LLP

(57) ABSTRACT

A dome cover supporter is capable of improving durability of a product and extending a life span thereof by preventing roof panels from protruding upwardly by supporting a dome cover used in a storage tank, achieving resistance against a load by decreasing surface roughness, and extending a life span by preventing gaskets from being exposed to ultraviolet rays. The dome cover supporter includes a supporter including supporter main body formed in a vertical direction, a base formed in lower portion of the supporter main body to support the supporter main body against the ground, and horizontal extending pieces bent in an upper portion of the supporter main body to be extended; and a fixing member fastened to an upper portion of the supporter to maintain a seal by fixing and pressing roof panels.

8 Claims, 8 Drawing Sheets

(51) Int. Cl.

| | |
|---|---|
| ***E04C 3/02*** | (2006.01) |
| ***E04H 7/06*** | (2006.01) |
| *E04C 3/04* | (2006.01) |

(56) References Cited

U.S. PATENT DOCUMENTS

| | | | | | |
|---|---|---|---|---|---|
| 3,909,994 | A | * | 10/1975 | Richter | 52/63 |
| 4,297,825 | A | * | 11/1981 | Harper, Jr. | 52/837 |
| 4,455,803 | A | * | 6/1984 | Kornberger | 52/395 |
| 4,608,790 | A | * | 9/1986 | Eberlein et al. | 52/81.3 |
| 5,333,425 | A | * | 8/1994 | Nickerson et al. | 52/222 |
| 2003/0163966 | A1 | * | 9/2003 | Reynolds et al. | 52/461 |
| 2004/0031230 | A1 | * | 2/2004 | Pabedinskas et al. | 52/729.1 |
| 2004/0168383 | A1 | * | 9/2004 | Reynolds et al. | 52/273 |

OTHER PUBLICATIONS

Notice of Allowance issued by the Korean Intellectual Property Office on Nov. 11, 2013.

* cited by examiner

DOME COVER SUPPORTER

CROSS-REFERENCE TO RELATED APPLICATIONS

The present application claims priority of Korean Patent Application No. 10-2013-0017018, filed on Feb. 18, 2013, which is incorporated herein by reference in its entirety.

BACKGROUND

1. Field

The present invention relates to a dome cover supporter, and more particularly, to a dome cover supporter capable of improving productivity and durability of a product and extending a life span thereof by preventing the pressing plate of roof panel from protruding upwardly by supporting a dome cover used in a storage tank, achieving resistance against a load by decreasing surface roughness, and extending a life span by preventing gaskets from being exposed to ultraviolet rays.

2. Description of Background Art

A dome cover is used for covering a storage tank storing a product, such as crude oil or oil, or a storage tank having sealing property and chemical resistance. In order to install the dome cover on an upper surface of the storage tank, a dome cover supporter capable of supporting the dome cover in a vertical direction is required.

FIG. 1 is a cross-sectional view illustrating a coupling state of a dome cover supporter 10 in the related art.

As illustrated, in the dome cover supporter 10 in the related art, a supporter main body 11 and a pressing plate 17 are vertically positioned, and end portions of roof panels (A) are inserted there between.

In this case, an upper surface of an oblique bar 13 supports a lower end surface of the roof panel A to stably support the roof panel A by using a lever principle.

However, in the dome cover supporter 10 in the related art, when a worker inserts a screw 15 in order to couple the supporter main body 11 and the pressing plate 17, the worker needs to ascend on the roof panel A for in order to perform the task.

In this case, when a load P corresponding to weight of the worker is applied to the roof panel A, is contact area between the oblique bar 13 and the roof panel A is narrow, such that there is a problem in that the roof panel A is bent as indicated by a dotted line.

When the bent state is maintained for a long time, there is a problem in that a gap is generated between the pressing plate 17 and the roof panel A because bending distortion is generated in the roof panel A itself, corrosion is generated because rainwater is permeated into the generated gap, and durability of the roof panel A itself deteriorates.

When the load P is applied, the oblique bar 13 is in first contact with the root panel A, so that a phenomenon in which stress is concentrated to a contact region, thereby causing a vulnerable structure in which a crack is generated inside the oblique bar 13 according to a case.

SUMMARY

In order to solve the aforementioned problems in the related art, the present invention has the following objects.

An object of the present invention is to provide a dome cover supporter, in which the pressing plate or roof panel is prevented from protruding upwardly, so that a step of removing a rib of an upper portion of a strut assembled with a gusset is omitted, thereby allowing a rapid production.

Another object of the present invention is to provide a dome cover supporter, which prevents the pressing plate of roof panels from protruding upwardly, thereby improving durability of a product and extending a life span thereof, decreases surface roughness, thereby achieving rigidity against a wind load, and is capable of preventing a gasket from being exposed to ultraviolet rays, thereby extending a life span.

Yet another object of the present invention is to provide a dome cover supporter, which is configured so as to have rigidity against a vertical load and stress against an axis-directional distortion load by supporting a dome cover used in a storage tank, thereby stably supporting a roof panel for a long time.

The present invention for achieving the aforementioned objects is implemented by an exemplary embodiment including a configuration below.

An exemplary embodiment of the present invention provides a dome cover supporter, inducting a supporter including a supporter main body formed in a vertical direction, a base formed in a lower portion of the supporter main body to support the supporter main body against the ground, and horizontal extending pieces bent in an upper portion of the supporter main body to foe extended; and a fixing member fastened to an upper portion of the supporter to maintain a seal by fixing and pressing roof panels.

The supporter of the dome cover supporter may include the supporter main body having an "I" shape of an entire cross-section so as to have rigidity against a vertical load; the base integrally formed with the lower portion of the supporter main body and configured to support the supporter main body from the ground so that the dome cover is stably and fixedly coupled to the upper portion of the supporter main body; and the horizontal extending pieces integrally formed with the upper portion of the supporter main body, bent at 45 degrees and extended to form accommodation portions so that a fixing member is seated therein without protruding, and configured to fasten roof panels to the upper portion of the supporter main body by fastening the supporter main body with bolts so that the bolts pass through the pressing plate, in which the roof panels are bent like a shape of an accommodation portion and seated therein, and then gaskets for maintaining a seal are seated on upper portions of the roof panels.

In the dome cover supporter of the present invention, the fixing member may be fastened to the upper portion of the supporter main body to fixedly fasten the roof panel and be provided with gaskets seated on end portions and upper portions of the roof panels to prevent snow or rainwater from being permeated, and a pressing plate may be formed on upper portions of the gaskets so that the pressing plate may be fastened to the supporter main body with the bolts to fix the roof panel and press the gaskets, so as to maintain a seal.

The present invention has the following effects by the aforementioned configuration.

According to the exemplary embodiment of the present invention, it is possible to have rigidity against a vertical load and stress against an axis-directional distortion load by supporting a dome cover used in a storage tank, thereby stably supporting tire roof panels for a long time.

According to the exemplary embodiment of the present invention, it is possible to allow a rapid production by preventing the pressing plate of roof panel from protruding upwardly to omit a step of removing a rib on an upper portion of a strut assembled with a gusset.

According to the exemplary embodiment of the present invention, it is possible to improve durability of a product and extend a life span thereof by preventing the pressing plate of roof panel from protruding upwardly, achieve resistance against a wind load by decreasing surface roughness, and extend a life span by preventing gaskets from being exposed to ultraviolet rays.

DETAILED DESCRIPTION FOR IMPLEMENTING THE INVENTION

Hereinafter, configurations of the present exemplary embodiment will be described in detail with reference to the accompanying drawings.

A detailed explanation of known related functions and constitutions may be omitted to avoid unnecessarily obscuring the subject matter of the present invention.

Figure 1:
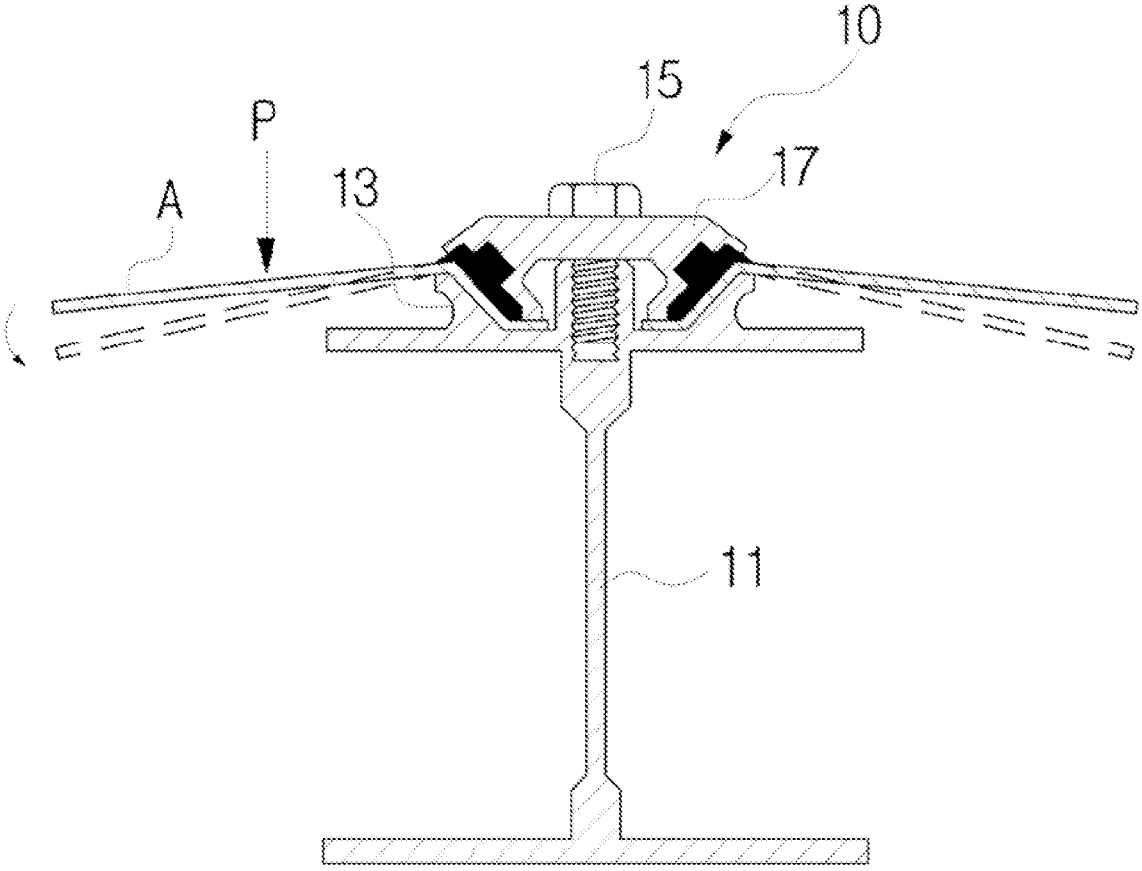
FIG. 1 (PRIOR ART)
FIG. 1 is illustrating an installation state 1 of a conventional dome cover supporter in the related art.
Figure 2:
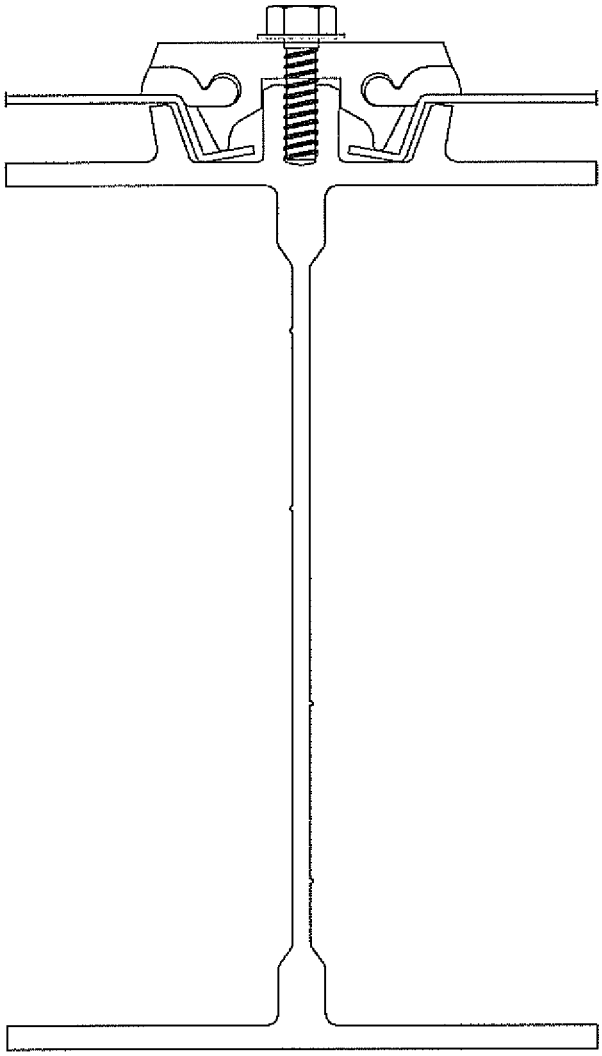
FIG. 2 (PRIOR ART)
FIG. 2 is illustrating an installation state 2 of a conventional dome cover supporter in the related art.
Figure 3:
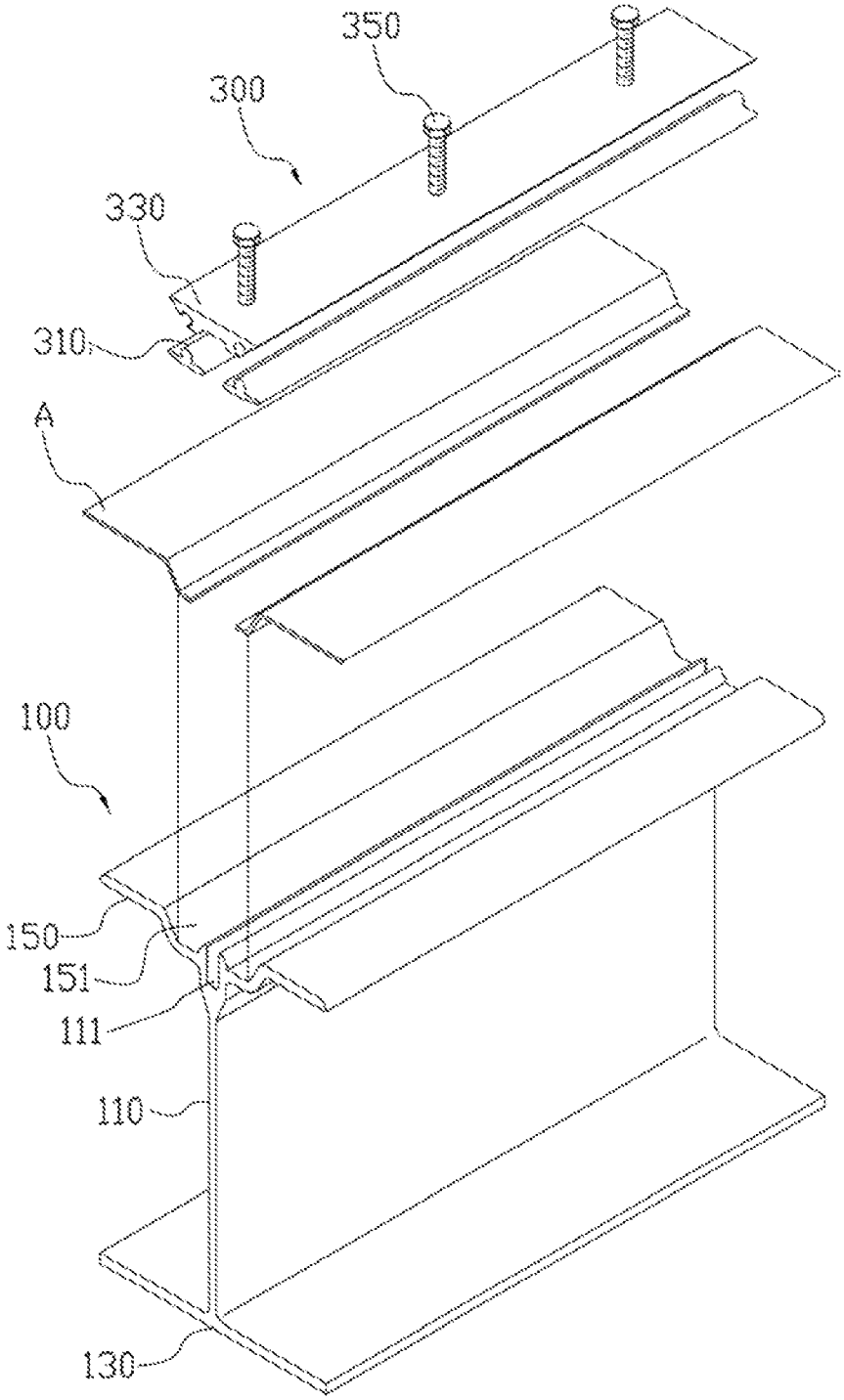
FIG. 3 is an exploded perspective view illustrating a construction of an I-type dome cover supporter according to the present invention.
Figure 4:
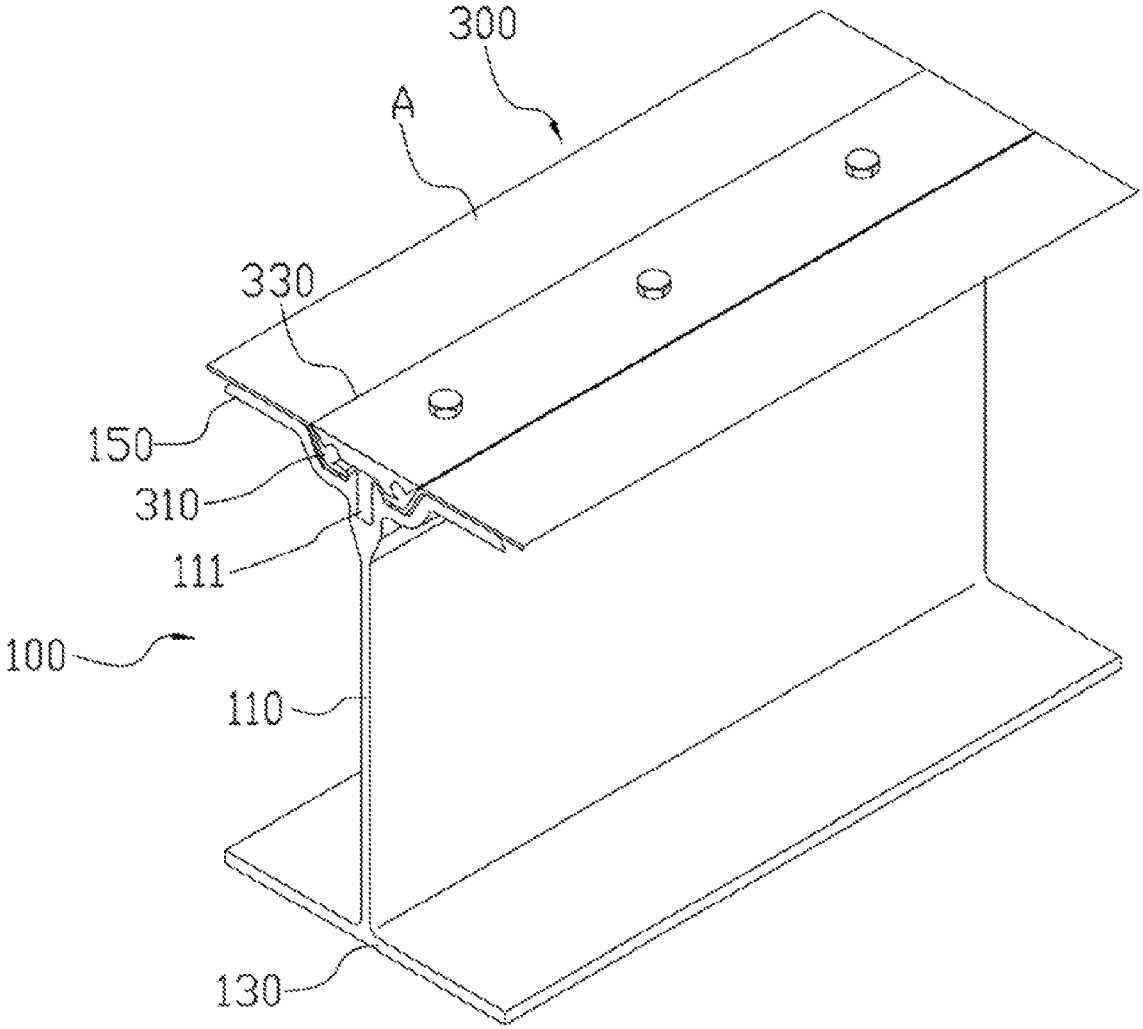
FIG. 4 is a perspective view illustrating a construction of the I-type dome cover supporter according to the present invention.
Figure 5:
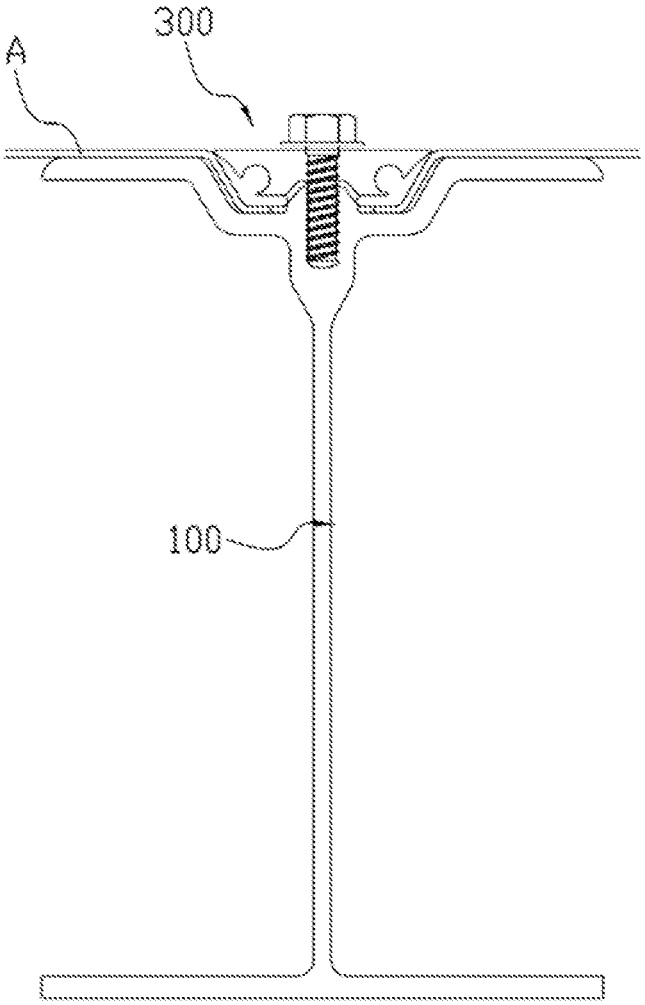
FIG. 5 is a cross-sectional view of the I-type dome cover supporter according to the present invention.

FIG. 3 is an exploded perspective view illustrating a construction of a dome cover supporter according to the present invention, FIG. 4 is a perspective view illustrating a construction of the dome cover supporter according to the present invention, and FIG. 5 is a cross-sectional view of the dome cover supporter according to the present invention.

As illustrated, the dome cover supporter according to the present invention includes a supporter 100 including supporter main body 110 formed in a vertical direction, a base 130 formed in a lower portion of the supporter main body 110 to support the supporter main body 110 against the ground, and horizontal extending pieces 150 bent in an upper portion of the supporter main body 110 to be extended, and a fixing member 300 fastened to an upper portion of the supporter to maintain a seal by fixing and pressing roof panels A.

The supporter main body 110 has an shape of an entire cross-section so as to have rigidity against the vertical load.

The base 130 is integrally formed with the lower portion of the supporter main body 110 to support the supporter main body 110 from the ground, so that the dome cover may be stably fixedly coupled to the upper portion of the supporter main body 110.

The horizontal extending piece 150 is integrally formed with the upper portion of the supporter main body 110, and is bent at 45 degrees to be extended, so that the fixing member 300 may be seated therein without protruding.

That is, the horizontal extending piece 150 is bent at 45 degrees to be extended so that an accommodation portion 151 is formed so as for the fixing member 300 to be seated therein without protruding. Accordingly, the roof panels A are bent like a shape of the accommodation portion 151 and seated in the accommodation portion 151, gaskets 310 for maintaining a seal are seated on the roof panels A, and then the gaskets 310 are fastened to the supporter main body 110 with bolts 350 so that the bolts 350 pass through the pressing plate 330, and thus the roof panels A are fastened to the upper portion of the supporter main body 110.

Figure 6:
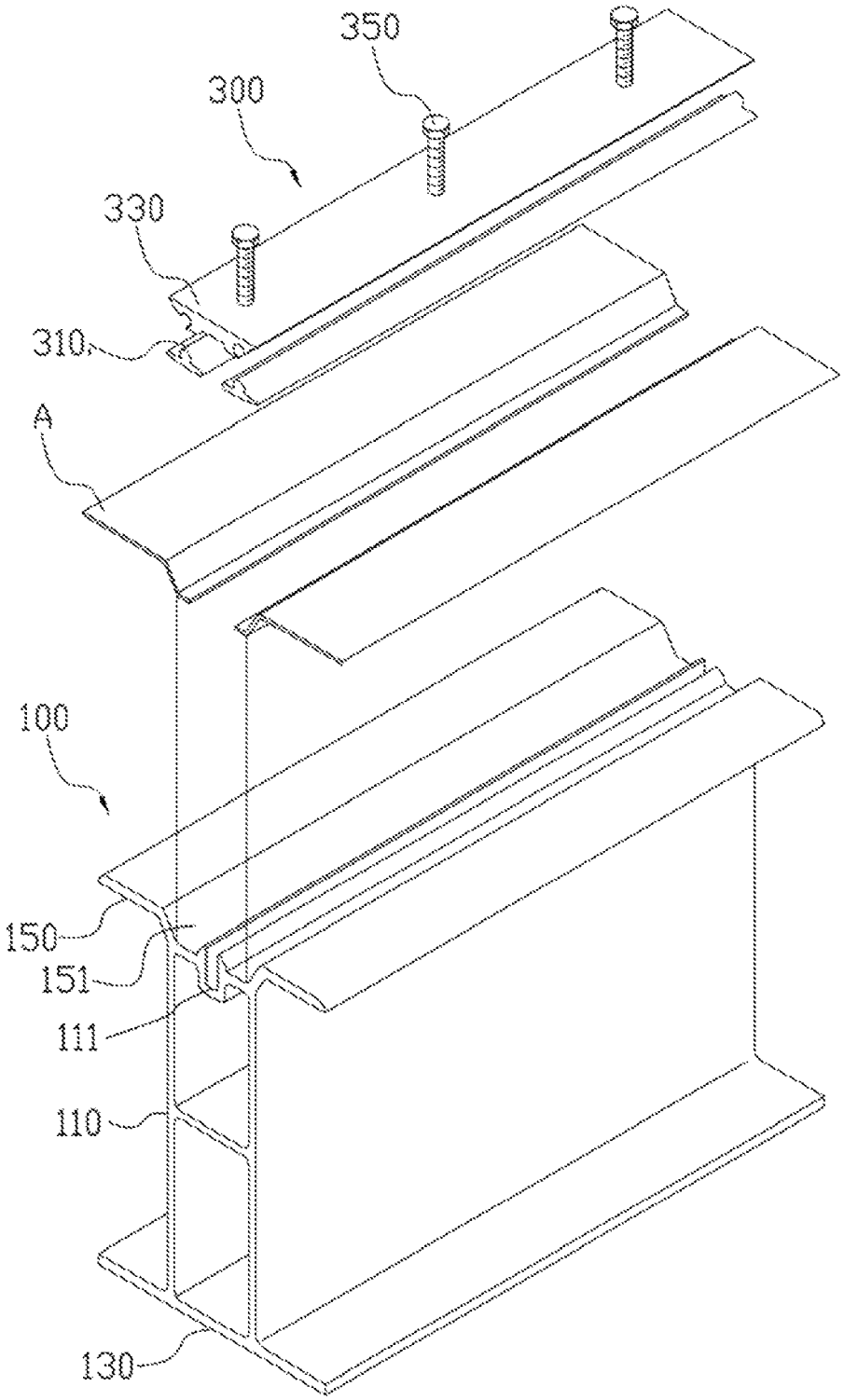
FIG. 6 is an exploded perspective view illustrating a construction of an H-type dome cover supporter according to the present invention.
Figure 7:
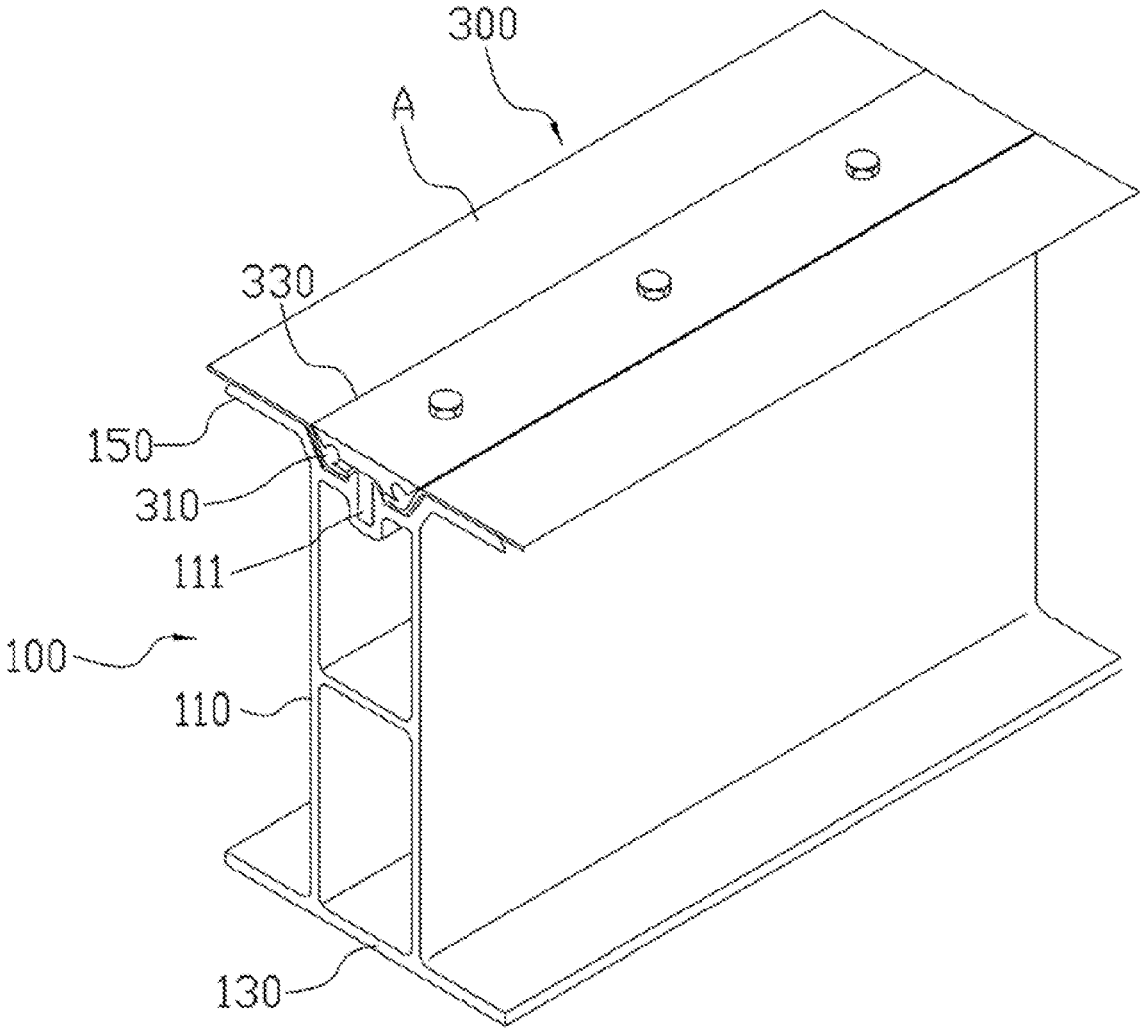
FIG. 7 is a perspective view illustrating a construction of the H-type dome cover supporter according to the present invention.
Figure 8:
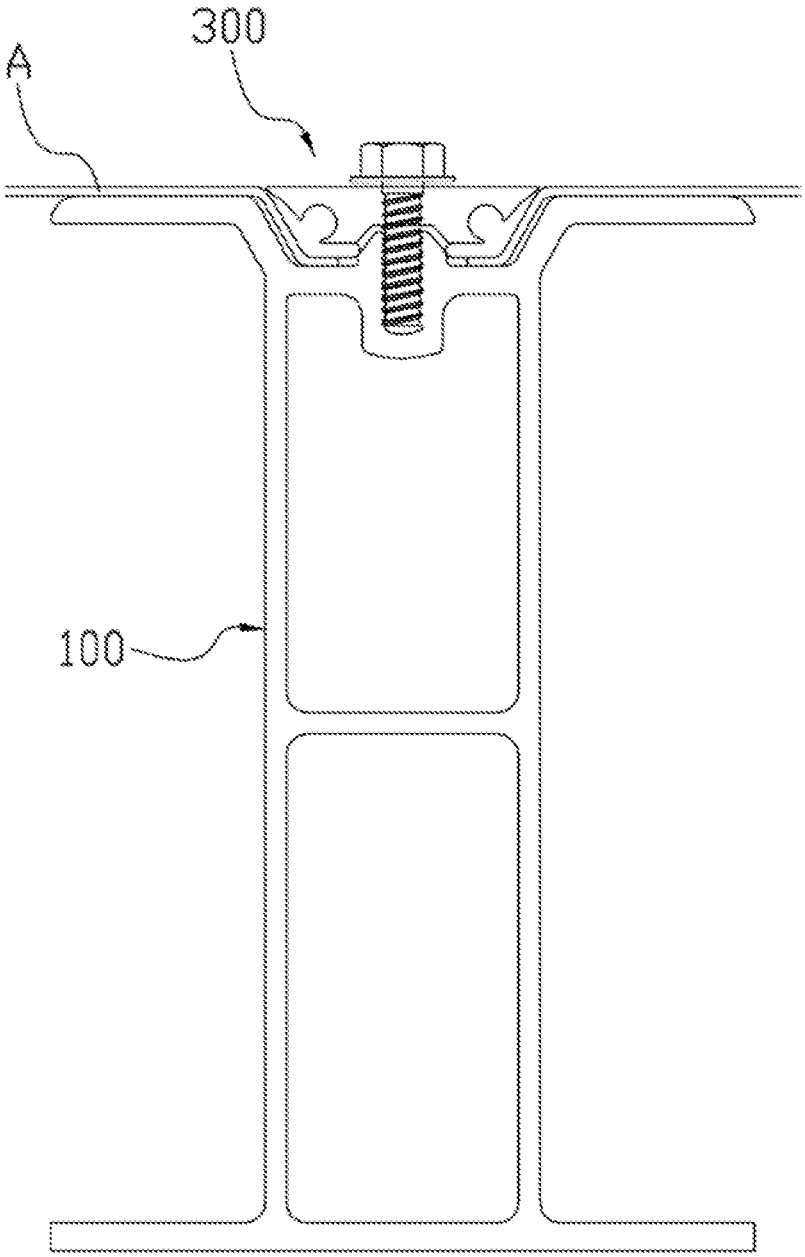
FIG. 8 is a cross-sectional view of the H-type dome cover supporter according to the present invention.

In this case, as illustrated in FIG. 6, the supporter main body 110 may be formed so that two support pillars correspond to each other while having an entire cross section shaped, like "H" to have strength against a vertical load and stress for an axis-directional distortion load.

The fixing member 300 is fastened to the upper portion of the supporter main body 110 to fixedly fasten the roof panels A, and includes the gaskets 310 seated on the end portions and the upper portions of the roof panel A so as to prevent snow or rainwater from being permeated, and the pressing plate 330 formed on the upper portions of the gaskets 310, to fasten the pressing plate 330 to the supporter main body 110 with the bolts 350. Accordingly, the fixing member 300 fixes the roof panels A, and simultaneously presses the gaskets 310 to maintain a seal.

A process of installing the dome cover by using the dome cover supporter 110 according to the present invention including the aforementioned configuration will be described with reference to FIGS. 3 and 4.

First, the supporter main body 110 is erected in a vertical direction, and the base 130 is coupled to the ground or the fixing member (not illustrated) to fix a position thereof.

In this case, a plurality of supporter main bodies 110 is installed in a radial direction, and front ends of the respective supporter main bodies 110 meet at one point.

Then, the roof panels A are disposed on the horizontal extending piece 150, and the gaskets 310 and the pressing plate 330 are positioned.

Then, the worker ascends to the upper surface of the roof panel A and couples the bolts 350 to screw insertion holes 111 by passing through the pressing plate 330.

According to the present invention, like FIG. 6 when the supporter main body is provided so that the two support pillars correspond to each other, to support the dome cover, the present invention has rigidity against a vertical load and stress against an axis-directional distortion load, also another embodiment of the present invention has further improvement of stably supporting the roof panel for a long time.

The present invention prevents the pressing plate roof panel from protruding upwardly, so that a step of removing a rib of an upper portion of a strut assembled with a gusset is omitted, thereby allowing a rapid production.

The present invention may improve durability of a product and extend a life span thereof by preventing the pressing plate of roof panel from protruding upwardly, achieves resistance against a wind load by decreasing surface roughness, and may extend a life span by preventing the gaskets from being exposed to ultraviolet rays.

The aforementioned present invention is not limited by the aforementioned exemplary embodiments and the accompanying drawings, and it will be apparent to a person with ordinary skill in the art to which the present invention pertains that the present invention may be variously substituted, modified, and changed within a scope without being departed from the technical spirit of the present invention.

What is claimed is:

1. A dome cover supporter with an "I" shape cross section, comprising:

a bottom flange having a first length and a first width with a first midpoint;

a top flange having a second length and second width with a second midpoint such that the second length and the second width are substantially equal to the first length and first width of the bottom flange, wherein the top flange is partitioned at the second midpoint into a first dome panel support extending from the second midpoint in a direction parallel to the bottom flange and a second dome panel support extending from the second midpoint in a direction opposite to the first dome panel support and parallel to the bottom flange, the top flange including a pressing plate conduit centered at the second midpoint, and having two sidewalls and a bottom surface formed from a respective portion of each of the first dome panel support and the second dome panel support nearest the second midpoint;

a web affixed at one end to the first midpoint and extends away from the bottom flange in a perpendicular direction, and at an opposite end has an expanded portion that is affixed to the second midpoint and perpendicular to the top flange, wherein the expanded web portion extends through the bottom surface of and into the pressing plate conduit;

a bolt conduit having a threaded inner surface formed in the expanded portion of the web, wherein the bolt conduit is positioned at the second midpoint and extends into the pressing plate conduit from the expanded portion of the web, such that side surfaces and the threaded inner surface of the bolt conduit protrude into the expanded portion of the web and the pressing plate conduit; and a pressing plate having a fourth length substantially equal to the first length, two side surfaces, a bottom surface, and a top surface with a fourth width with a fourth midpoint substantially equal to a width of the pressing plate conduit, at least one bolt hole positioned at the fourth midpoint and aligned with the bolt hole conduit, such that when the pressing plate is affixed onto the pressing plate conduit by inserting a bolt through the bolt hole into the bolt conduit, the top surface of the pressing plate is substantially coplanar with the first and second dome panel supports of the top flange, and the bottom surface of the pressing plate opposes the bottom surface of the pressing plate conduit and surrounds a top surface and the protruding side surfaces of the bolt conduit.

2. The dome cover supporter with an "I" shape cross section of claim 1, further comprising:

two gaskets, one gasket affixed to one of the two side surfaces of the pressing plate and the other gasket affixed to the other of the two side surfaces of the pressing plate, so that the one of the two gaskets opposes and contacts one of the two sidewalls of the pressing plate conduit and another of the two gaskets opposes and contacts the other sidewall of the pressing plate conduit.

3. The dome cover supporter with an "I" shape cross section of claim 2, wherein the pressing plate further includes two gasket conduits, one gasket conduit positioned on each side surface of the pressing plate such that each of the two gasket conduits accommodate one of the two gaskets.

4. The dome cover supporter with an "I" shape cross section of claim 3, further comprising:

two roof panels each having a first section and a second section wherein the first section of each roof panel conforms to a shape of one of the sidewalls and a portion of the bottom surface of the pressing plate conduit and does not obstruct the bolt hole conduit when positioned in the pressing plate conduit, and the second section conforms to the shape of one of the first and second dome panel supports such that when the first section of each of the two roof panels are positioned in the pressing plate conduit and the pressing plate is positioned over the two roof panels and secured to the bolt conduit, the second section of each of the two roof panels contacts the respective first and second dome panel support and the top surface of the pressing plate is substantially coplanar with a top surface of the second section of each of the two roof panels.

5. A dome cover supporter with an "H" shape cross section, comprising:

a bottom flange having a first length and a first width with a first midpoint;

a top flange having a second length and second width with a second midpoint such that the second length and the second width are substantially equal to the first length and first width of the bottom flange, wherein the top flange is partitioned at the second midpoint into a first dome panel support extending from the second midpoint in a direction parallel to the bottom flange and a second dome panel support extending from the second midpoint in a direction opposite to the first dome panel support and parallel to the bottom flange, the top flange including a pressing plate conduit centered at the second midpoint, and having two sidewalls and a bottom surface formed from a respective portion of each of the first protrusion and the second protrusion nearest the second midpoint;

two webs, wherein each of the two webs is affixed parallel to each other at a common end to the bottom flange and extend away from the bottom flange in a perpendicular direction, and an opposite common end of each of the two webs is affixed parallel to each other and perpendicular to the top flange;

a center support having a third length with a third midpoint, that connects the two webs to each other at opposite ends of the third length, and is positioned between and parallel to the bottom flange and the top flange, wherein the third midpoint is substantially positioned directly over the first midpoint and substantially positioned directly under the second midpoint;

a bolt conduit that is positioned at the second midpoint, having a threaded inner surface that extends from a void formed between the center support, the top flange and the two connected webs and extends into the pressing plate conduit such that side surfaces and the threaded inner surface of the bolt conduit protrude into the pressing plate conduit and the void formed between the two connected webs, the center support and the top flange; and a pressing plate having a fourth length substantially equal to the first length, two side surfaces, a bottom surface, and a top surface with a fourth width with a fourth midpoint substantially equal to a width of the pressing plate conduit, at least one bolt hole positioned at the fourth midpoint and aligned with the bolt hole conduit, such that when the pressing plate is affixed onto the pressing plate conduit by inserting a bolt through the bolt hole into the bolt conduit, the top surface of the pressing plate is substantially coplanar with the first and second dome panel supports of the top flange, and the bottom surface of the pressing plate opposes the bottom surface of the pressing plate conduit and surrounds a top surface and the protruding side surfaces of the bolt conduit.

6. The dome cover supporter with an "H" shape cross section of claim 5, further comprising:

two gaskets, one gasket affixed to one of the two side surfaces of the pressing plate and the other gasket affixed to the other of the two side surfaces of the pressing plate, so that the one of the two gaskets opposes and contacts one of the two sidewalls of the pressing plate conduit and another of the two gaskets opposes and contacts the other sidewall of the pressing plate conduit.

7. The dome cover supporter with an "H" shape cross section of claim 6, wherein the pressing plate further includes two gasket conduits, one gasket conduit positioned on each side surface of the pressing plate such that each of the two gasket conduits accommodate one of the two gaskets.

8. The dome cover supporter with an "H" shape cross section of claim 7, further comprising:

two roof panels each having a first section and a second section wherein the first section of each roof panel conforms to a shape of one of the sidewalls and a portion of the bottom surface of the pressing plate conduit and does not obstruct the bolt hole conduit, and the second section conforms to the shape of one of the first and second dome panel supports such that when the first section of each of the two roof panels are positioned in the pressing plate conduit and the pressing plate is positioned over the two roof panels and secured to the bolt conduit, the second section of each of the two roof panels contacts the respective first and second dome panel support and the top surface of the pressing plate is substantially coplanar with a top surface of the second section of each of the two roof panels.

* * * * *